United States Patent [19]

Lobasov

[11] 3,986,531

[45] Oct. 19, 1976

[54] LOOM FOR WEAVING A SLIDE-FASTENER ELEMENT TO A TAPE

[75] Inventor: Stanley Lobasov, Washington Heights, N.Y.

[73] Assignee: Flair Zipper Corporation, New York, N.Y.

[22] Filed: Apr. 25, 1974

[21] Appl. No.: 463,746

[52] U.S. Cl. ..... 139/442; 139/11; 139/116; 139/384 B

[51] Int. Cl.[2] ..... D03D 47/06

[58] Field of Search ..... D03D/47/08; 139/11, 139/116, 122 R, 123, 124 R, 124 A, 384 B, 429–432, 440–442

[56] References Cited

UNITED STATES PATENTS

| | | | |
|---|---|---|---|
| 2,497,077 | 2/1950 | Firing et al. | 139/124 A |
| 3,136,343 | 6/1964 | Firing | 139/124 A |
| 3,181,570 | 5/1965 | Clarke | 139/124 A |
| 3,457,964 | 7/1969 | Burbank | 139/124 A |
| 3,457,965 | 7/1969 | Burbank | 139/11 |
| 3,480,045 | 11/1969 | Negro | 139/11 |
| 3,682,205 | 8/1972 | Scott | 139/124 A |

FOREIGN PATENTS OR APPLICATIONS

| | | | |
|---|---|---|---|
| 1,804,973 | 5/1970 | Germany | 139/124 A |
| 6,914,574 | 12/1970 | Netherlands | 139/116 |
| 342,539 | 1/1960 | Switzerland | 139/11 |

*Primary Examiner*—James Kee Chi
*Attorney, Agent, or Firm*—Gottlieb, Rackman, Reisman & Kirsch

[57] ABSTRACT

A loom for weaving a slide fastener element to a tape, the loom weaving two tapes, and a slide fastener element to each tape, simultaneously. The slide-fastener element is fed along with the warp ends to the weaving area, and undergoes simultaneous shedding movement with the warp ends. The filling needle is driven in an elliptical path through each successive warp shed. The eye of the needle, through which the filling passes, moves closely adjacent to the weaving point in the first half of its path and then moves distantly away from the weaving point in the second half of its path. Each pick of the filling thereby catches and binds the slide-fastener element at a location immediately adjacent to the weaving point.

13 Claims, 13 Drawing Figures

LOOM FOR WEAVING A SLIDE-FASTENER ELEMENT TO A TAPE

The present invention relates to looms for weaving tapes, and more specifically to looms for weaving tapes and for weaving slide-fastener elements to tapes, with both steps occurring simultaneously.

Looms for weaving tapes and weaving slide-fastener elements to the tapes simultaneously are known in the art and have been accepted commercially. The principle of operation of these looms is well understood. A slide fastener element is fed to the weaving area alongside the warp ends, and shedding movement is given to both the element and the warp ends at the same time. As the filling needle moves successively through the warp sheds thereby weaving the tape, the filling needle passes over and under the slide-fastener element thereby "catching" and binding the slide-fastener element to the edge of the tape.

Such needle looms conventionally have drives which move the filling needle in an elliptical path through successive warp sheds. The needle initiates its movement from one side of the tape through each warp shed along an "inserting" segment or half of the elliptical path distant from the weaving point to the other side of the tape, and then returns to its initial point along a "retreating" segment or half of its elliptical path adjacent to the weaving point. The slide-fastener element was treated as a warp end, and was fed along with the warp ends to the weaving point along one side of the group of warp ends, and shedding movement was imparted to the slide-fastener element at the same time as such movement was given to the warp ends, so that the slide-fastener element formed a part of each successive warp shed, with such element constituting one edge of the tape.

Due to the conventional "in and out" elliptical movement of the filling needle, the filling would enter the warp shed at a point somewhat distant, i.e., downstream, from the weaving point, and would continue to be inserted across the warp ends in the shed along a segment of the elliptical path distant from the weaving point. The warp reed performed the function of beating the filling, that is, sliding the filling from the location at which it had been inserted by the filling needle, up tightly against the weaving point.

However, due to the usual deeply contoured configuration of the slide-fastener element, the filling could not be pushed along the element toward the weaving point by the beating action of the reed. For this purpose, the slide-fastener element was passed through a hollow tube to the weaving point and the tube was given the same shedding movement. When the filling needle made its successive convolutions through successive warp sheds, the filling would pass around the tube. The filling, as a result of normal filling tension, would slide off of the tube at a point immediately adjacent to the weaving point, thereby catching and binding the slide-fastener element at the proper location.

The prior art has uniformly used a tube or other mechanical device for enabling the filling to stay clear of the slide-fastener element, until the filling was brought to a location adjacent to the weaving point, whereupon the filling was released so as to engage the slide-fastener element. Hendley, U.S. Pat. No. 3,123,103, issued Mar. 3, 1964, is believed to be one of the first such prior art looms. It teaches that in a needle loom, two weaving devices can be utilized to weave two tapes and a slide fastener element to each such tape simultaneously. In the said Hendley patent, each slide fastener element is passed through a hollow tube, the tube terminating at a point closely adjacent to the weaving point. As the two filling needles travel through successive warp sheds, they wrap the filling about the tubes, and the filling slides off the tubes as the result of tension so that they catch the slide-fastener elements at the weaving point.

It would be highly desirable to provide a loom for simultaneously weaving a tape and a slide fastener element to a tape, which would treat the slide fastener element as an ordinary warp end, without a requirement for ensheathing the slide fastener element with a mechanical device while the filling needle is traveling through successive warp sheds.

Thus, it is the primary object of the present invention to provide a loom for weaving a tape and a slide fastener element to such a tape simultaneously, which eliminates any need for a special mechanical device for ensheathing the slide fastener element during the weaving process.

It is a further object of the present invention to provide a weaving loom of the type described, which treats the slide fastener element as essentially just another warp end.

It is still a further object of the present invention to provide a weaving loom of the type described in which the supply of the slide fastener element to the weaving point is relatively free-flowing and self-feeding.

It is still a further object of the present invention to provide a loom of the type described having a specially-configured filling needle, such needle having a wedge-shaped, bullet-shaped nose whereby when it enters the warp shed, it will part the warp shed further, thereby enabling the filling to be inserted in the warp shed properly.

It is still a further object of the present invention to provide a weaving loom of the type described which is simpler in operation, which has fewer mechanical parts, and which is easier to operate than previous looms for weaving tapes and slide fastener elements to such tapes.

In accordance with the foregoing objects, there is provided a loom for weaving tapes and a slide fastener element to each such tape simultaneously. The slide fastener elements travel to the weaving point from a source of supply with only relatively minor restraint and guidance. Thus, the slide fastener elements are delivered and shedding movement is given to them, as is given to any warp end. The filling needles are driven through elliptical paths through successive sheds, but the inserting segment of the path, that is, the first half of the path, is along a line closely adjacent to the weaving point, where the slide fastener element meets the weaving point. The second half of the elliptical path, that is, the retreating segment of the path, is somewhat distant from the weaving point. Hence, since the filling crosses the slide fastener element at a location closely adjacent to the weaving point, the slide fastener element is properly bound to the tape.

Further objects and advantages of the present invention will become apparent from the following description of a preferred embodiment taken in conjunction with the accompanied drawings.

Figure 2:
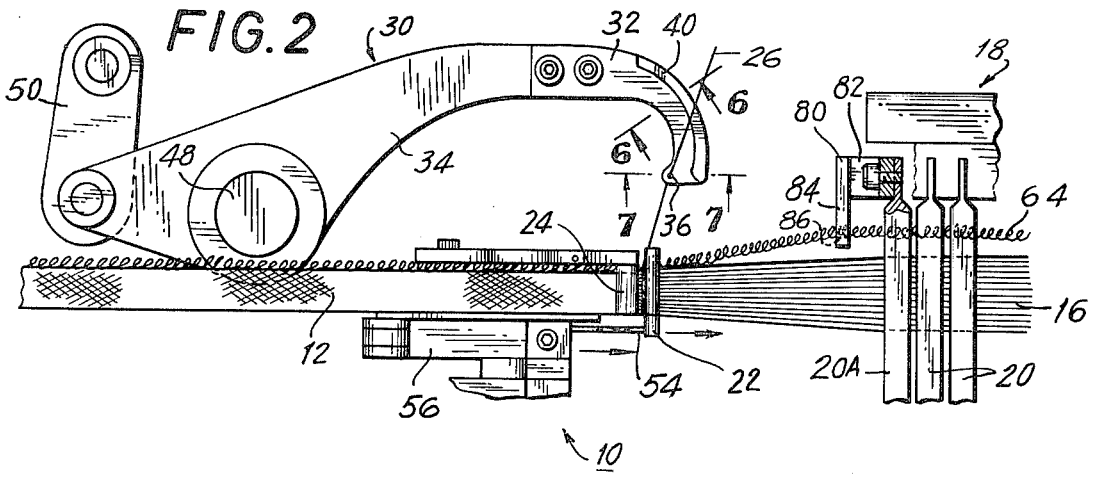
FIG. 2 is a fragmentary, enlarged top plan view of the weaving area of the loom, showing especially the relative positions of the filling needle, the slide-fastener element and the weaving point, at an initial position of the filling needle in its cycle of operation.
Figure 5:
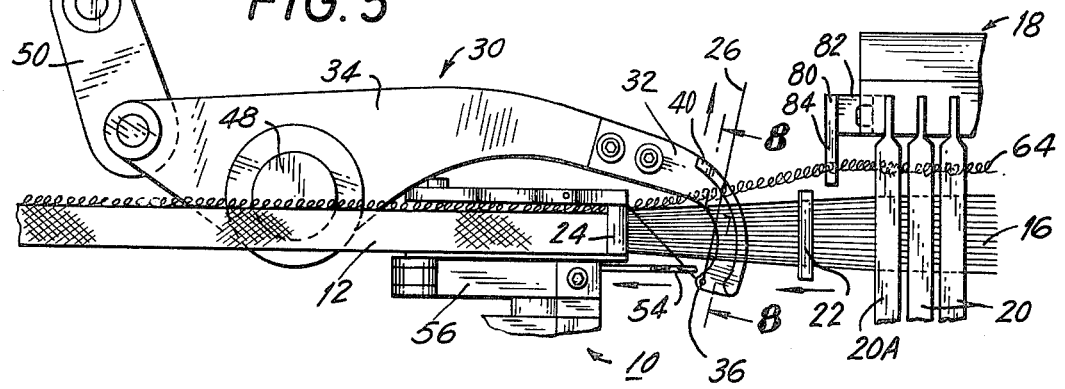
Figure 6:
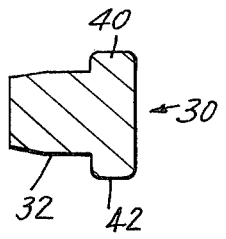
Figure 7:
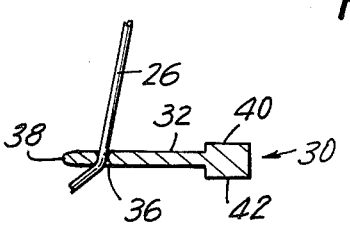
Figure 8:
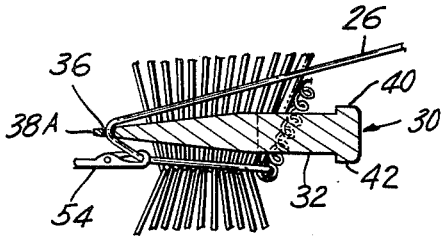
Figure 9:
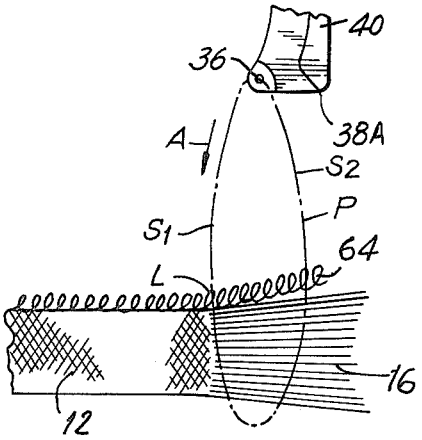

FIGS. 6, 7 and 8 are cross-sectional views of different areas of the filling needle, taken along the lines 6—6, 7—7 and 8—8 of FIGS. 2 and 5 respectively; and FIG. 9 shows the path of the eye of the filling needle, as it completes one cycle of entering the warp shed, exiting the other side of the warp shed, and again returning to its initial position.

Figure 1:
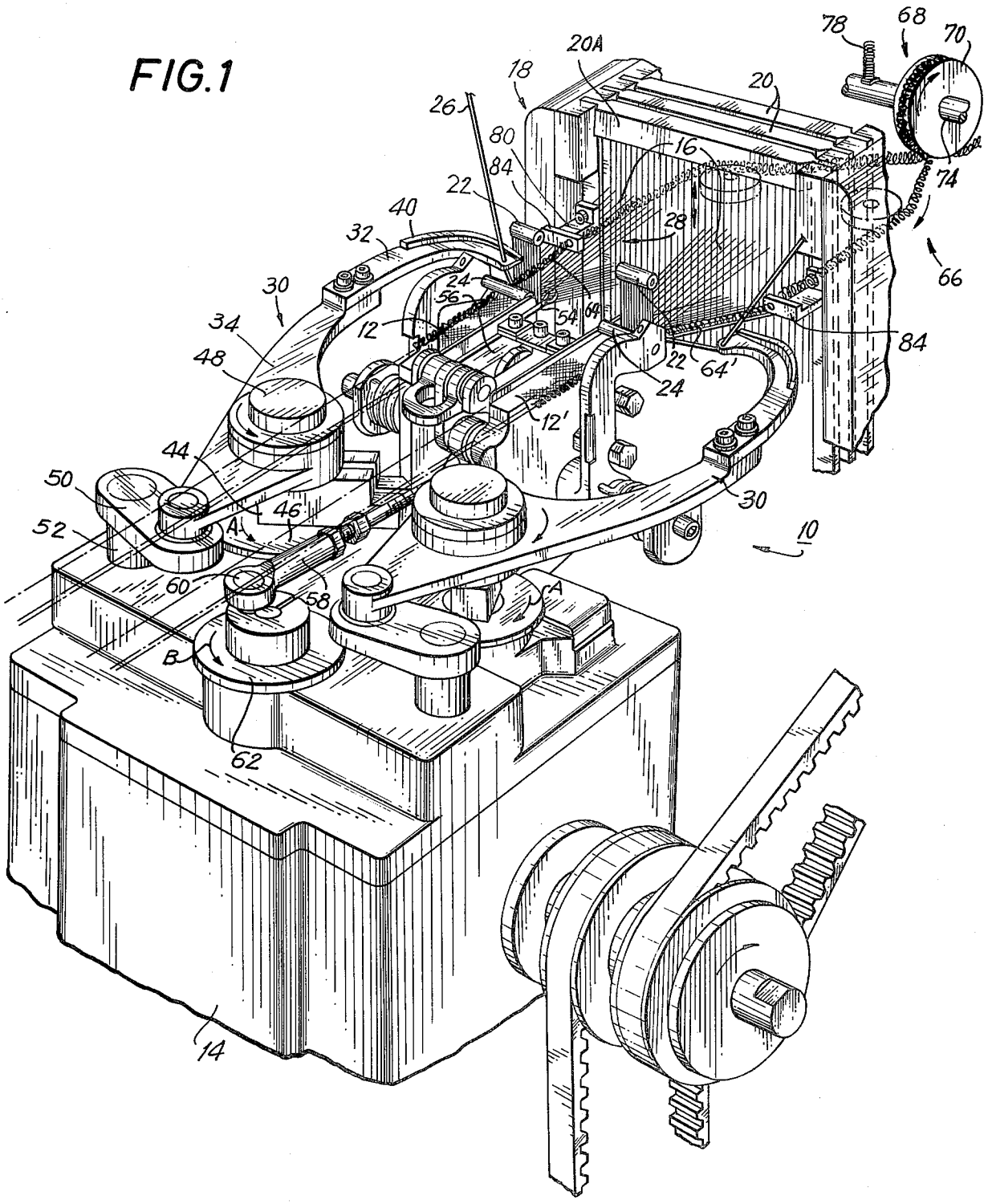
FIG. 1 is a perspective view of the loom for weaving a slide-fastener element to a tape, according to the present invention.

Referring initially to FIG. 1 of the drawing, a needle loom 10 is shown, having the capability of simultaneously weaving two tapes 12, 12′. Such looms are conventional. Needle looms of the same general type and construction are shown and described in Turner, U.S. Pat. No. 2,902,057, issued Sept. 1, 1959, and described in Gagliardo, U.S. Pat. No. 3,224,467, issued Dec. 21, 1965. Accordingly, a detailed description of such needle looms will not be given herein, but a generalized recitation as most pertinent to the present invention will be made.

The needle loom 10 includes a base 14, and the usual warp creel, yarn cones and yarn guides, all the latter not being shown. The warp ends 16 lead from the creel, through various delivery mechanisms, now shown, to a harness arrangement, including a harness guide 18. The usual harnesses 20 are held within the harness guide 18, and are raised or lowered by a conventional harness cam drive, not shown, to impart the usual shedding movement to the warp ends. The warp ends 16 then pass through a pair of reeds 22 and run to a weaving point, which is immediately behind a pair of tape guides 24. The tapes 12, 12′ are advanced by a conventional take-up mechanism, also not shown.

The loom 10 is adapted for weaving two tapes 12, 12′ at the same time, and simultaneously weaving two slide-fastener elements, one to each tape, so as to provide a more efficient weaving operation. The mechanisms for weaving the tapes, as well as for weaving the slide-fastener elements to the tapes, are mirror-images of one another, and therefore only the weaving mechanism on the left hand side, as seen in FIG. 1, will be described in detail hereafter.

Filling 26 is inserted in the successive sheds 28 formed by the harnesses 20 by a filling needle 30 which, as will be described in greater detail later, follows an elliptical path through successive warp sheds 28. The needle 30 includes a curved needle body 32, which is secured to a needle arm 34. The needle body 32 has an eye 36 at its entering or leading end, through which the filling 26 passes. As seen in FIGS. 1 and 6, 7 and 8, the leading end or head of the needle body 32 is somewhat wedge-shaped, sloping toward a relatively thin leading edge 38, and having, on both the upper and lower faces thereof, curved ribs 40, 42, respectively. These faces flank the leading edge 38 and smoothly lead rearwardly from such edge.

The filling needle 30 is driven through its elliptical path by an eccentric drive mechanism, which is conventional on such looms, and which includes an eccentric block 44 driven by a vertical shaft, not shown, which terminates in a circular head 46. The direction of rotation of the circular head 46 is indicated by the arrow A in FIG. 1. A shaft 48 is carried by the eccentric block 44, such shaft, of course, being off-center with respect to the shaft which terminates in the circular head 46. As the shaft 48 follows an eccentric motion, it imparts motion to the filling needle 30. The other end of the filling needle 30 is controlled in its movement by a link 50, which rocks on a shaft 52, rising from the base 14. The motion of shaft 48, and the control given by link 50, produces the desired elliptical path of the needle 30.

Each weaving mechanism of the loom has associated with it, a knitting device on the inner side of each tape 12, 12′. Such devices are conventional and utilize a knitting needle 54, usually of the latch type. The knitting needle 54 is reciprocated in a substantially horizontal plane by a knitting needle drive generally 56, enabling movement of the knitting needle in a plane parallel to the plane of movement of the tapes 12, 12′. The drive 56 is a given movement via a drive arm 58, connected to an eccentric stud 60 carried by a rotating plate 62, the plate rotating continuously in the direction indicated by arrow B in FIG. 1.

In addition to the weaving of tapes, the present invention has as its object, the simultaneous weaving of slide fastener elements to such tapes. The elements 64, 64′ may be made of any suitable resilient material, and may be of any configuration, capable of providing mating components which may be controllably locked to one another by a zipper slider. Such slide fastener elements are conventionally made of continuous plastic filament of either a ladder-type or coiled configuration, as is known in the art. Such slide fastener elements are conventionally woven to the tape, immediately adjacent to a cord or a thickened area, such cord or area constituting the most-adjacent warp ends of the tape.

Looms for weaving slide-fastener elements to tapes are known as shown in Hendley, U.S. Pat. No. 3,123,103 issued Mar. 3, 1964. The improvement of the present invention with respect to such looms will now be set forth. The filling needle 30 travels in a constant, substantially horizontal plane. To enable the filling needle to weave the slide-fastener element 64 to the tape, it is necessary that there by a shedding movement imparted to the slide-fastener element at the same time that shedding movement is imparted to the warp ends 16. For this purpose, a joined pair of slide fastener elements are lead from a conventional source of supply 66, see FIG. 1, to a tension-producing mechanism 68. Said mechanism may include a pulley 70 having a peripheral groove 72, the pulley being mounted on a shaft 74 which has a "drag" imposed on it by a brake, for example, a friction pad 76 riding on the shaft, with force being applied to urge the pad 76 against the shaft by a spring mechanism 78. The slide-fastener pair makes one turn about the pulley 70, is separated into the two slide-fastener elements 64, and each element passes by a small guide wheel to a slide-fastener holder 80 mounted on the forward-most harness 20, on a side portion of its frame. The holder includes an arm 82, see FIGS. 1 and 2, bolted to the harness frame, and an inward extension 84, the extension including an aperture 86 through which the slide-fastener element 64 passes relatively freely, being restrained primarily only by the mentioned brake.

The movement of the slide-fastener element 64 from its source of supply 66 to the weaving point is essentially free-flowing, being only restrained to a slight degree by the tension-producing element 68, and being guided only by the extension 84. As the forward most harness 20A reciprocates upwardly and downwardly, it carries the holder 80 with it, thereby imparting a "one up one down" shedding movement to the slide-fastener element 64, simultaneously with the shedding movement imparted to the warp ends 16. Thus, the slide-fastener element 64 will be successively slanting above and below the plane in which the weft-laying needle 30 oscillates.

Figure 2A:
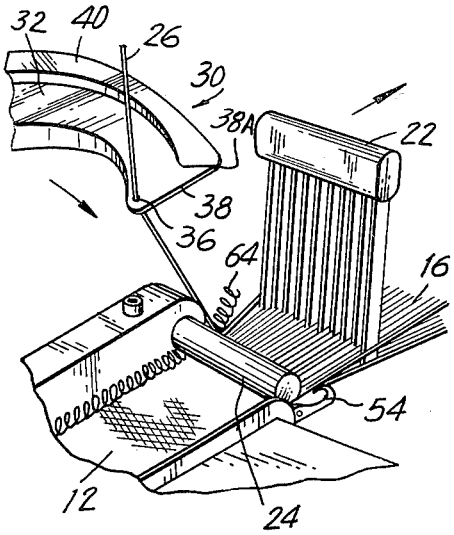
FIG. 2A is a detailed perspective view of the weaving area of the loom, and showing the filling needle, the slide-fastener element and the weaving point in the same relative positions as those shown in FIG. 2.

The various positions of the filling needle 30 are seen in FIGS. 2 through 5, and FIGS. 2A through 5A. FIGS. 2 and 2A show the initial position of the filling needle, somewhat removed from the outer side of the tape 10. As the needle 30 starts its elliptical path, along the inserting segment thereof, it reaches a position shown in FIGS. 3 and 3A, where it has just entered the warp shed 36, with the needle being closely adjacent to the weaving point. The proximity of the eye 36, carrying the filling 26 over the weaving point, ensures that the filling will catch the slide-fastener element 64 at a point also closely adjacent to the weaving point. The path of the eye is sufficiently close to the weaving point so that the filling will be inserted around the convolution of the slide-fastener element at the weaving point. There must be at least one filling per convolution. As the filling needle 30 continues its elliptical path, it reaches the point shown in FIGS. 4 and 4A, wherein the eye 36 of the needle 30 is adjacent to the inner side of the tape 10, but still within the shed. As the needle 30 reaches the end of one pass through the warp shed, and is ready to begin its return movement through the shed, still along the elliptical path, the needle reaches the point portrayed in FIGS. 5 and 5A, with the eye of the needle now being beyond the inner edge of the tape 10.

The filling needle 30 has now inserted a "double" pick of filling in the warp shed, with one pick of the double pick facing, i.e. being closest to, the fell and the other pick of the double pick facing the harnesses 20, i.e. being further away from the fell. The knitting needle 54 has moved toward the needle to grasp each pick of the filling 26 on the inner side of the tape 10, so as to weave a selvedge edge on that side of the tape in a well-known manner. The needle 30 now continues along its elliptical path, on the retreating segment thereof, back to its initial position shown in FIGS. 2 and 2A, ready once again to repeat the same cycle. As the shed changes due to the action of the harness arrangement, it will be appreciated that the slide-fastener element 64 is first on one side of and then on the other side of the plane in which the filling needle travels. Hence, as the filling needle passes through successive warp sheds, it will insert the filling 26 over the slide-fastener element 64 in one elliptical movement and will then insert the filling under the slide-fastener element in the next elliptical movement. This has the effect of weaving the slide-fastener element to the tape, simultaneously with the weaving of the tape itself.

Figure 3:
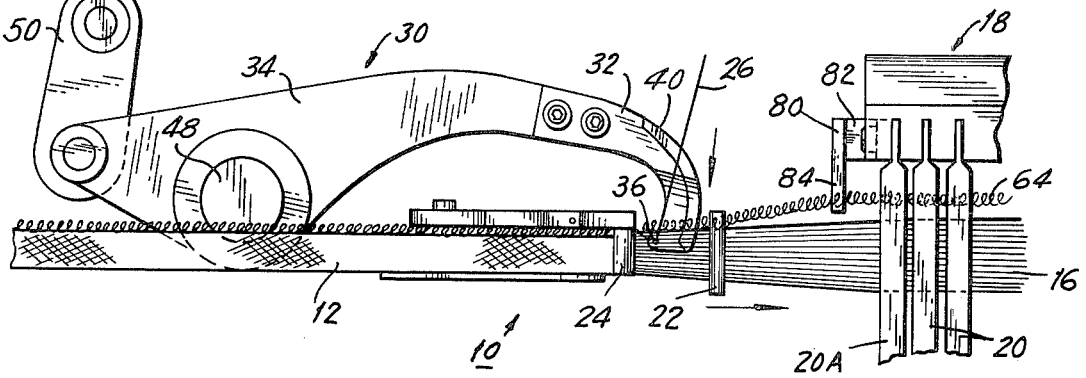
FIGS. 3, 4 and 5 are figures similar to FIG. 2, but showing the different successive positions of the filling needle, as it passes through the warp shed, and exits on the interior side of the warp shed.
Figure 4:
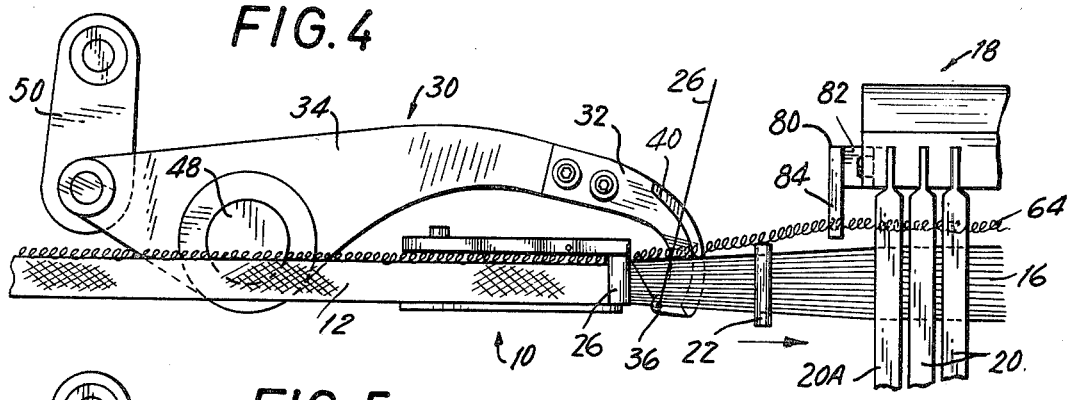
Figure 3A:
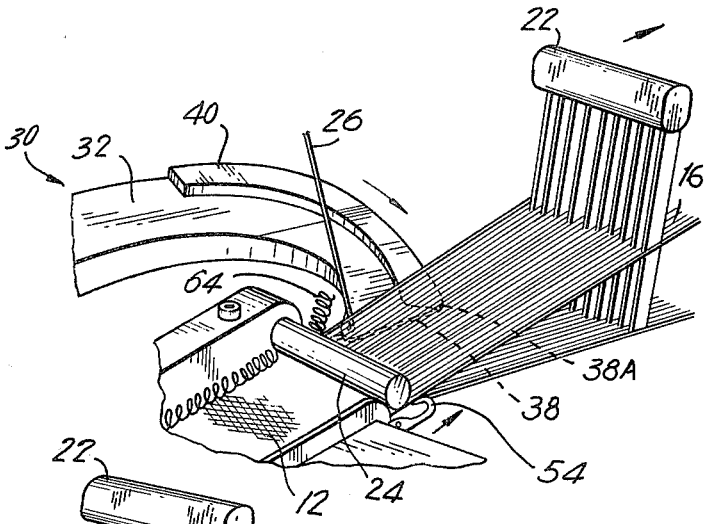
FIGS. 3A, 4A and 5A are figures similar to FIG. 2A, but showing in perspective the successive positions of the filling needle, as the positions shown in FIGS. 3, 4 and 5 respectively.
Figure 4A:
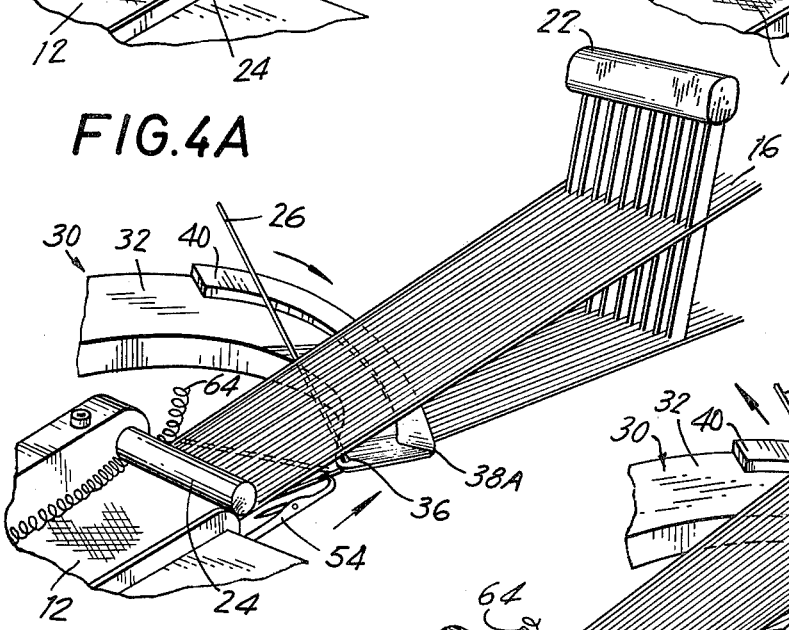
Figure 5A:
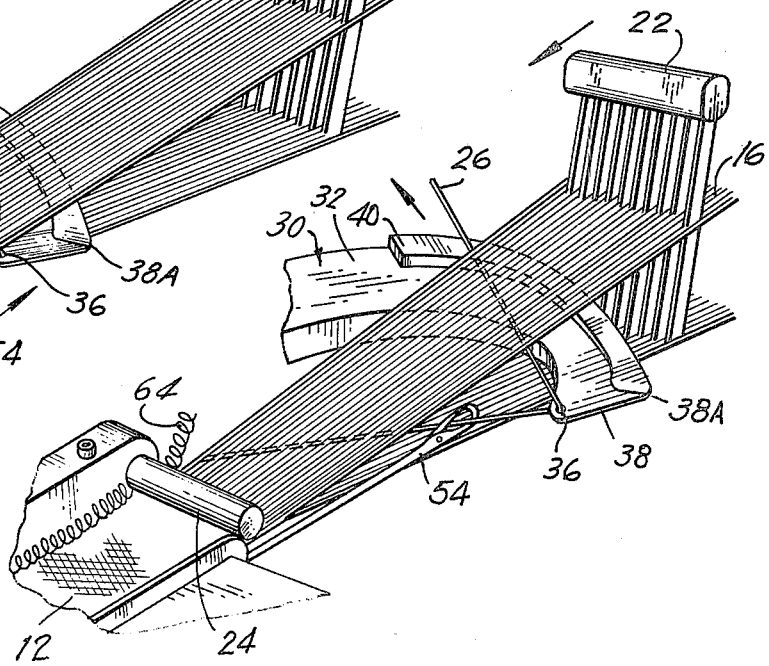

The filling needle 30 desirably has the previously-mentioned wedge-shaped leading configuration, to make certain that it will enter each successive shed properly, and to make certain that it will part the upper warp ends away from the lower warp ends, should they be temporarily out of alignment. For this purpose, as best seen in FIGS. 3 and 3A, at the moment the needle 30 enters the shed, it has a wedge-shaped, somewhat bullet-shaped leading edge at 38A, with the eye 36 of the needle offset and behind this end. The eye is offset in a direction toward the weaving point (see FIG. 9). The bullet-shaped leading end 38A thus enters the warp shed first, before the needle eye 36, and protrudes well into the shed when the eye is at the edge of the warp shed. As best seen in FIG. 3A, the edge 38A is slightly more than half-way into the shed, when the eye is at said edge. The bullet-shape of the edge 38A, if necessary, opens the shed somewhat further, so that the eye 36 of the weft-laying needle may insert the filling 26 properly, closely adjacent to the weaving point, especially at the segment of the weaving point located at the slide-fastener element 64.

Continuing rearwardly from the bullet-shaped edge 38, the sloping ribs 40, 42 serve further to enable the needle to pass through the shed, the ribs 40, 42 being relatively narrow, as compared with the width of the body 32, so as to cause very little friction between the warp ends and the upper and lower sides of the curved needle body 32.

Referring to FIG. 9 of the drawings, the path P of the drawings, the path P of the eye 36 of the needle 30 is shown by a dot and dash line in plan view. Initially, the needle is situated on one side of the tape, this being the side on which the slide-fastener element 64 is located. The needle then begins a pass through a warp shed, initiating its movement along a segment $S^1$ of the path, this segment constituting the inserting half of said path. At this point, the needle moves in the direction of arrow A in FIG. 9. As the needle continues along the segment $S^1$, the eye 36 reaches a point where it carries the filling across the slide-fastener element 64. At this location L, the eye carries the filling closely adjacent to the weaving point, placing the filling in the first convolution of the slide fastener element, adjacent the weaving point. It will be seen that the inserting segment $S_1$ of the path crosses the slide fastener element 64 at a point substantially in line with the weaving point or the fell of the tape. Next the needle carries the eye along the remaining portion of the segment $S^1$ until the eye reaches the other side of the tape 12. Next, the needle carries the eye along the segment $S^2$ of the path P, such segment constituting the retreating half of the path. It will be seen that this segment $S^2$ of the path is somewhat distance from the weaving point. When the needle moves along segment $S_1$, it locates the pick in a position in the shed facing the fell, and when the needle moves along segment $S_2$, it locates the pick in a position in the shed facing the harnesses 20, as previously referred to.

It will be appreciated that due to the path given to the eye of the needle, no mechanical device such as a tube is required to ensheath the slide-fastener element, whereby filling slide off the tube to engage the slide-fastener element at the weaving point. Further, it will be appreciated that the slide-fastener element is treated as would be any warp end, in a simple and efficient manner and without the requirement of special devices. Thus, shedding movement is imparted to the slide-fastener element by the harness arrangement, by the same motion and by the same mechanism used to impart shedding movement to the warp ends passing through the first harness.

Further, the needle travels through a simple elliptical path in a constant horizontal plane, without any need for special movements for lifting or tilting the same.

It will be noted that the slide-fastener element is self-feeding, being advanced forwardly by the same take-up device operating on the tape. There is no need for a special slide-fastener element drive, as is standard in the prior art.

Since the leading edge 38 of the needle is bullet-shaped, it will help to open the warp shed if the warp ends are not in alignment. Due to this function of the needle, the harness 20 can be reciprocated through relatively short strokes, so that the loom can be driven at a high rate.

The simplicity of the foregoing arrangements eliminate the usual mechanical repairs required for more complex mechanisms. The same simplicity enables the loom to be run at a high speed.

What I claim is:

1. In a loom for weaving tape and for simultaneously weaving a configured slide-fastener element to such tape, the loom including means for feeding warp ends to the fell of the tape, means for feeding the slide-fastener element along one side of the warp ends to the fell, means for imparting concurrent shedding movement to the warp ends and to the slide-fastener element, a filling needle having an eye, and means for feeding filling to the eye of the filling needle, the improvement comprising reciprocating means for inserting and withdrawing the filling needle through successive warp sheds, said reciprocating means guiding the eye of the needle through a path laying a double pick in the shed, the path having an inserting segment wherein the needle lays a pick facing the fell and travels from the slide-fastener side of the shed to the opposite side of the shed and having a withdrawing segment wherein the needle lays a pick facing the shedding means and travels from said opposite side of the shed back to the slide-fastener side to the shed, the inserting segment of the path crossing the slide-fastener element at a point substantially in line with the fell of the tape so that the filling is deposited directly into the configuration of the slide-fastener element at the fell.

2. The improvement as set forth in claim 11 wherein the withdrawing segment of the path crosses the slide-fastener element at a point distant from the fell of the tape.

3. The improvement as set forth in claim 1 wherein the reciprocating means drives the needle through an elliptical path.

4. The improvement as set forth in claim 3 wherein the elliptical path has a long axis which passes through successive warp sheds.

5. The improvement as set forth in claim 3 wherein the path is in a plane which intersects successive warp sheds.

6. The improvement as set forth in claim 1 wherein the filling needle has its leading end of wedge-shaped configuration.

7. The improvement as set forth in claim 1 wherein the means for imparting shedding movement to the slide-fastener element includes a harness, means for periodically raising and lowering such harness, and a holder for the slide-fastener element, the holder being attached to the harness.

8. The improvement as set forth in claim 1 wherein two tapes are woven and one slide-fastener element is woven to each tape simultaneously.

9. The improvement as set forth in claim 1, wherein the path is curvilinear.

10. A method of weaving a tape and simultaneously weaving a slide fastener element to the tape, said method including the steps of:

a. supplying warp ends to the fell of the tape and supplying a slide-fastener element along one side of the warp ends, b. ulitizing shedding means to inpart concurrent shedding movement to the warp ends and the slide-fastener element, c. reciprocating a filling needle carrying filling through successive warp sheds so as to lay a double pick in each shed, d. guiding the filling needle along a path starting on the side of the warp ends at which the slide-fastener element is located, the path then running toward the fell of the tape, the path having an inserting segment wherein the needle lays a pick facing the fell the path thereby crossing the slide-fastener element at a point substantially in line with the fell of the tape, and crossing across a warp shed and exiting the other side of the warp shed, and the path then withdrawing back across the warp shed through a withdrawing segment wherein the needle lays a pick facing the shedding means.

11. The method as set forth in claim 10 wherein the path is elliptical.

12. The method as set forth in claim 10 wherein the path is withdrawn from the warp shed distantly from the fell of the tape.

13. The method as set forth in claim 10 wherein two tapes are woven and one slide-fastener element is woven to each tape simultaneously.

* * * * *